US006178671B1

(12) United States Patent
Zwanenburg et al.

(10) Patent No.: US 6,178,671 B1
(45) Date of Patent: Jan. 30, 2001

(54) STEAM IRON WITH CALCIFICATION INDICATION

(75) Inventors: Godwin D. Zwanenburg, Hoogeveen (NL); Heng S. Neo, Singapore (SG); Kok K. Yap, Singapore (SG); Singh Kaldip, Singapore (SG)

(73) Assignee: U.S. Philips Corporation, New York, NY (US)

( * ) Notice: Under 35 U.S.C. 154(b), the term of this patent shall be extended for 0 days.

(21) Appl. No.: 09/400,959

(22) Filed: Sep. 22, 1999

(30) Foreign Application Priority Data

Sep. 22, 1998 (SG) ..... 9803799

(51) Int. Cl.[7] ..... D06F 75/18; C02F 5/00
(52) U.S. Cl. ..... 38/77.8
(58) Field of Search ..... 38/77.8, 77.83, 38/77.3, 77.5; 210/282, 94, 89, 85

(56) References Cited

U.S. PATENT DOCUMENTS 4,969,393 * 11/1990 Mahlick et al. ..... 38/77.8 X
5,063,697 * 11/1991 Valente et al. ..... 38/77.8 X

FOREIGN PATENT DOCUMENTS

3223969A1 1/1984 (DE) ..... A47J/31/58
489714 * 6/1992 (EP) ..... 38/77.8
2632331 * 12/1989 (FR) ..... 38/77.8
95/16378 6/1995 (WO) ..... A47J/31/54

* cited by examiner

*Primary Examiner*—Ismael Izaguirre
(74) *Attorney, Agent, or Firm*—Ernestine C. Bartlett

(57) ABSTRACT

A steam iron with an indicator for indicating calcification is provided in which the iron is provided with a timer for measuring an accumulated time of use of the steam iron, and an actuator for activating the indicator when the accumulated time exceeds a predetermined threshold level. The timer measures the time of use of the steam iron, the accumulated time of use being indicative of the amount of scale deposited in the steam chamber and steam vents. When the accumulated time of use exceeds a threshold the calcification indicator is activated to warn the user that a self-clean action is to be performed. The time of use measurement may be obtained by accumulating the time of use only during steam generation, or it may be obtained by correcting the accumulated time of use with a weighting factor which depends on the steaming rate. The weighting factor may be made dependent on the hardness of the water to be steamed, or it is further possible to make the threshold level for activating the calcification indicator dependent on the hardness of the water.

9 Claims, 1 Drawing Sheet

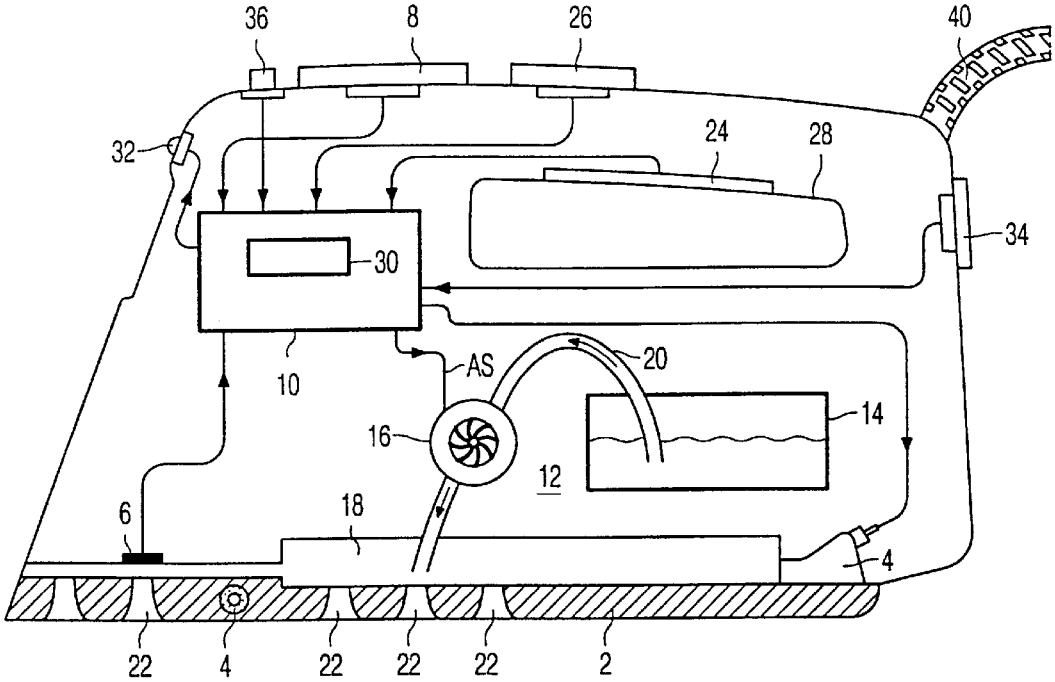
36
8
26
40
32
24
28
34
30
10
AS
20
14
16
12
6
18
4
22
4
22
22
22
2

STEAM IRON WITH CALCIFICATION INDICATION

The invention relates to a steam iron with calcification indication. Such a steam iron is known from PCT International Application No. WO 95/16378. The present invention is concerned with the effects of mineral deposits, often referred to as calcification or scaling, in the steam chamber and the steam vents of a steam iron. In areas with so-called hard water the deposition of minerals in apparatus in which tap water is heated to temperatures above 68 degrees centigrade is inevitable. The effect of the calcification depends on the construction of the apparatus. In coffee brewers the calcification obstructs the water flow through the water conduit and therefore the coffee brewer must be periodically cleansed, for example, with vinegar to remove the scale. In practice, the user often forgets the regular decalcification of the apparatus. In the long run the thickness of the deposited layer of scale causes overheating and the apparatus may burn out. In steam irons similar problems may occur. The user is expected to perform a self clean action in order to remove the deposited scale from the walls of the steam chamber and the steam vents. For this purpose the user must disconnect the power cord of the hot iron from the A.C. mains voltage and fill the iron with cold water. The thermal shock caused by the cold water on the hot walls of the steam chamber and the steam vents removes the thin calcification layer from the walls. Also the users of steam irons often forget to regularly perform such a self-clean action.

Many solutions have been invented to warn the users that the calcification has reached a certain limit and that the apparatus has to be cleansed. In said PCT International Application No. WO 95/16378 the temperature of the hot water is repeatedly measured and compared with an initial temperature. If the temperature difference exceeds a given value, an acoustic or visual signal indicates that the apparatus is calcified. Offenlegungsschrift DE 32 23 969 discloses a coffee maker having a timer which measures the time to heat up the cold water. When the conduit is calcified this time is longer and the calcification indicator is activated when this time exceeds a predetermined value. However, these known techniques require a fixed volume of cold water to start with and are not suitable for steam irons, as the temperature and the volume of cold water are not fixed but variable.

It is therefore an object of the present invention to provide a steam iron with a suitable calcification indication. To this end, the steam iron with calcification indication is characterized in that it comprises an indicator for indicating calcification, timing means for measuring an accumulated time of use of the steam iron, and means for activating the indicator when the accumulated time exceeds a predetermined threshold level.

The timing means measure the time of use of the steam iron. The accumulated time of use is indicative of the amount of scale deposited in the steam chamber and steam vents. When the accumulated time of use exceeds a threshold the calcification indicator is activated to warn the user that a self-clean action is to be performed. A refinement of the time of use may be obtained by accumulating the time of use only during steam generation. A further refinement may be obtained by correcting the accumulated time of use with a weighting factor which depends on the steam rate. The higher the steaming rate, the faster the time-of-use accumulation proceeds. Alternatively, the weighting factor may be made dependent on the hardness of the water to be steamed. It is further possible to make the threshold level for activating the calcification indicator dependent on the hardness of the water. The softer the water, the longer the interval between two self cleans can be. The hardness of the water can be selected by means of a dial set by the user or by a hidden switch to be set in the shop.

The above and other features and advantages of the invention will be apparent from the following description of exemplary embodiments of the invention with reference to the accompanying drawing, in which:

The sole FIGURE shows a schematic cross sectional view of an embodiment of a steam iron according to the invention.

The steam iron has a soleplate 2, which is heated by an electric heating element 4. The temperature of the soleplate 2 is measured with a temperature sensor 6, for example a resistor with a positive (PTC) or negative (NTC) temperature coefficient, thermally coupled to the soleplate 2. The desired soleplate temperature can be adjusted by means of a temperature dial 8. A control unit 10 compares the temperature of the soleplate 2 with the desired temperature and controls the heater 4 accordingly. Other temperature control systems, such as a conventional thermostat, are possible as well. Steam is generated by a steam generator 12 which comprises a water tank 14, a water pump 16 and a steam chamber 18 heated by the soleplate 2. The water pump 16 pumps water from the water tank 18 to the steam chamber 18 via a hose 20 under command of a pump signal AS from the control unit 10. The water evaporates in the steam chamber 18 and escapes through steam vents 22 in the soleplate 2. The steam rate is adjusted by means of a dial 26. The steam iron further has a hand sensor 24, for example a capacitive sensor, incorporated in the handgrip 28. The hand sensor 24 reports to the control unit 10 whether the steam iron is in use or not. The control unit 10 comprises a timer 30 which measures the time of use of the steam iron. The timer 30 may comprise a clock pulse generator and a counter for counting the clock pulses. The timer activates a scale or calcification indicator 32 when the counter has counted a predetermined number of clock pulses. The indicator 32 may be a light emitting diode (LED) mounted at a suitable place, but other indication systems, such as a liquid crystal display (LCD) and/or a beeper or buzzer may be employed as well. The hardness of the water can be communicated to the timer 30 by means of an optional dial 34 to be set by the user or by means of a selection switch (not shown) mounted inside the steam iron and to be set by a qualified person in the shop where the iron is sold. The iron further has a push button 36 which is to be activated by the user to start a self-clean action. The electronic circuits of the control unit 10 and the timer 30 receive a DC supply voltage derived from the AC mains voltage via the power cord 40. Back-up batteries or back-up capacitors (not shown) are used to supply DC supply voltage to circuitry (not shown) for storing information and for other purposes.

When the steam iron is in use, the hand sensor 24 supplies a signal to the timer 30 and the timer 30 starts counting clock pulses and thus measures the time that the iron is in use. The counted number is stored and saved when the iron is disconnected from the mains. When the accumulated number of counted clock pulses exceeds a predetermined amount, the time-out value, the timer 30 activates the indicator 32, thus warning the user that the scale in the iron should be removed by means of a self clean action. During such a self-clean action the hot iron is disconnected from the AC mains voltage, the tank 14 is filled with cold water and the push button 36 is pressed. The push button 36 activates the water pump 16 and cold water is pumped to the hot steam chamber 18 and the hot steam vents 22. The sudden cooling down of the thin scale layers on the walls of the steam chamber 18 and in the steam vents 22 causes the layers to break into pieces which are washed away by the passing cold water. After the self-clean action the counter of the timer 30 is reset for a new counting session and the activation of the indicator 32 stops. It is to be noted that mechanical pump and valve systems, manually operated by the user, can also be employed to admit water from the water tank 14 to the steam chamber 18.

The in-use timing may be refined by sensing whether steam is generated or not and to stop the counter of the timer 30 when no steam is generated. This can be accomplished, for example by monitoring the pump signal AS. When the water pump 16 runs, steam is being generated, so that the pump signal AS is indicative of steam being generated.

The in-use timing may be further refined by making the counting of the clock pulses dependent on the steam rate adjusted with the dial 26. In this way the timer 30 adapts the measurement of the accumulated time with a weighting factor which depends on the steam rate. When the steam rate is low, more clock pulses are used to reach the time-out value, and when the steam rate is high, less clock pulses are used. In this way the timer 30 makes allowance for the faster deposition of scale when more steam is generated. An alternative way is to weight the time with a weighting factor which depends on the hardness of the water as set by means of the dial 34. It is further possible to make the time-out value of the counter in the timer 30 dependent on the hardness of the water, so that hard water causes an earlier time-out than soft water.

The invention is not limited to the embodiment shown in the sole FIGURE. All electronic functions may be replaced by more conventional counterparts. The timer 30, for example, may be a mechanical timer; the water pump 16 may be a manually operated pump or valve system; the temperature control may employ a conventional thermostat and the weighting of the timing in dependence on the steam rate and/or the hardness of the water may be accomplished by a suitable gearing in the timer.

What is claimed is:

1. A steam iron with calcification indication, which comprises an indicator for indicating calcification, a control unit which comprises a timer for measuring an accumulated time of use of the steam iron, and for activating the indicator when the accumulated time exceeds a predetermined threshold level.

2. A steam iron with calcification indication, which comprises an indicator for indicating calcification, a control unit which comprises a timer for measuring an accumulated time of use of the steam iron, and for activating the indicator when the accumulated time exceeds a predetermined threshold level, wherein the steam iron further comprises steam sensing means for generating a steaming signal indicative of steam generation, the timer only being operative to measure the accumulated time if the steaming signal indicates steam generation.

3. A steam iron as claimed in claim 2, characterized in that the steam iron further comprises means for sensing the steam rate, the timing means being operative to adapt the measurement of the accumulated time with a weighting factor which depends on the steam rate.

4. A steam iron as claimed in claim 3, wherein the control unit is operative to adapt the measurement of the accumulated time with a weighting factor which depends on the hardness of the water to be steamed.

5. A steam iron as claimed in claim 3, further comprising means for adjusting the predetermined threshold level to the hardness of the water to be steamed.

6. A steam iron as claimed in claim 2, wherein the control unit is operative to adapt the measurement of the accumulated time with a weighting factor which depends on the hardness of the water to be steamed.

7. A steam iron as claimed in claim 2, further comprising means for adjusting the predetermined threshold level to the hardness of the water to be steamed.

8. A steam iron with calcification indication, which comprises an indicator for indicating calcification, a control unit which comprises a timer for measuring an accumulated time of use of the steam iron, and for activating the indicator when the accumulated time exceeds a predetermined threshold level, wherein the timer is operative to adapt the measurement of the accumulated time with a weighting factor which depends on the hardness of the water to be steamed.

9. A steam iron with calcification indication, which comprises an indicator for indicating calcification, a control unit which comprises a timer for measuring an accumulated time of use of the steam iron, and for activating the indicator when the accumulated time exceeds a predetermined threshold level, said iron further comprising means for adjusting the predetermined threshold level to the hardness of the water to be steamed.

* * * * *